United States Patent [19]

Huston

[11] 4,095,930

[45] Jun. 20, 1978

[54] FUEL BURNING SYSTEM

[75] Inventor: Duane A. Huston, Cleveland, Tenn.

[73] Assignee: Olin Corporation, New Haven, Conn.

[21] Appl. No.: 737,977

[22] Filed: Nov. 2, 1976

[51] Int. Cl.[2] ..... F23N 1/00

[52] U.S. Cl. ..... 431/90; 137/6; 137/90; 431/12

[58] Field of Search ..... 431/89, 90, 12, 5, 202; 137/6, 7, 90, 75; 236/14, 15 E

[56] References Cited

U.S. PATENT DOCUMENTS

| | | | |
|---|---|---|---|
| 3,135,314 | 6/1964 | Brunner | 431/12 |
| 3,241,597 | 3/1966 | Juzi | 431/12 X |
| 3,388,862 | 6/1968 | Gabrielson | 431/12 X |
| 3,607,117 | 9/1971 | Shaw et al. | 431/12 X |
| 3,722,811 | 3/1973 | Osburn | 431/12 X |
| 3,734,675 | 5/1973 | Osburn | 431/12 |
| 3,894,834 | 7/1975 | Estes | 431/12 X |
| 3,955,589 | 5/1976 | Beazley | 137/75 |
| 3,999,936 | 12/1976 | Hasselmann | 431/346 X |

*Primary Examiner*—Edward G. Favors

*Attorney, Agent, or Firm*—Bruce E. Burdick; Donald F. Clements; Thomas P. O'Day

[57] ABSTRACT

A system for burning two fuels in a burner wherein the second fuel is available in varying amounts. In response to the sensing of the available supply of the second fuel and the sensing of the total fuel required to be supplied to the burner, the system proportions the total fuel supplied to the burner between the first and second fuels to use as much of the second fuel as the supply will permit to meet the total fuel requirement. In addition, the system cuts off the supply of the first fuel to the burner when the available supply of the second fuel is adequate to meet the total fuel requirement and turns on the supply of the first fuel when the available supply of the second fuel is not adequate to meet the total fuel requirement.

1 Claim, 1 Drawing Figure

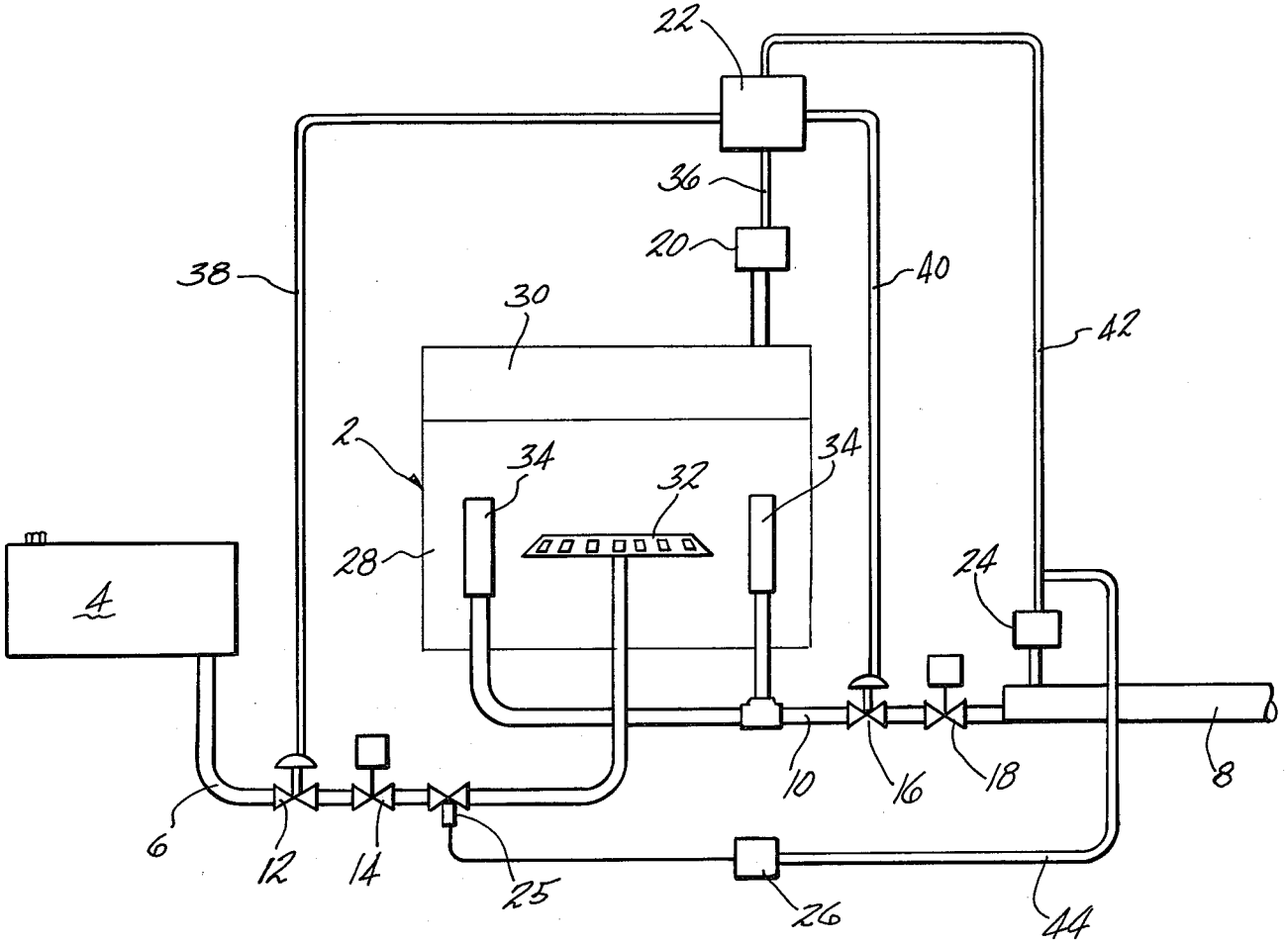
8
42
44
24
18
40
16
34
10
26
22
36
20
32
30
34
25
2
28
14
12
38
6
4

FUEL BURNING SYSTEM

This invention relates to an improved system for burning two or more fuels and more particularly to such a system wherein there is no need for base loading any of the fuels.

The present invention is particularly applicable to systems wherein a regular fuel such as fuel oil and a second or by-product fuel are burned or combusted together. The by-product fuel, which, for example may be hydrogen from the electrolysis of brine in a chlor-alkali cell, is usually available in varying amounts. In order to meet the energy demand a regular fuel is also used. As the supply of the by-product fuel supply varies, in normal practice, the regular fuel is fed to the burner as required but never less than some predetermined minimum rate. The second, or by-product fuel is fed to the burner as it is available in a preset ratio with the regular fuel. Thus, the regular fuel is "base loaded".

When the energy demand drops below the level where it is met by the combined combustion of the available by-product fuel and the minimum amount of regular fuel, the excess by-product fuel must be vented or otherwise disposed of. This has economic consequences as the by-product fuel is usually lost, and the regular fuel, which is usually more expensive than the by-product fuel, is being used when there is available by-product fuel to replace it.

Accordingly, the present invention has for its object an improved system for burning at least two fuels wherein one fuel, which is available in varying amounts, is more fully utilized.

Another object of the present invention is a system for burning at least two fuels in varying proportions automatically without the need to base load one fuel to the burner.

These and other objects and advantages of the present invention may be accomplished according to a preferred embodiment of the present invention through the provision of means for supplying a first fuel to a burner and means for providing a second fuel to the burner. Means are provided for sensing the available supply of the second fuel along with means for sensing the total fuel required to be supplied to the burner. Means operates in response to the sensing of the available supply of the second fuel and the total fuel required for proportioning the total fuel supplied to the burner between the first and second fuels to use as much of the second fuel as the supply will permit to meet the total fuel requirement and to cut off the supply of said first fuel when the available supply of said second fuel is adequate to meet the total fuel requirement and to turn on the supply of said first fuel when the supply of said second fuel is not adequate to meet the total fuel requirements.

The present invention will be more readily understood by reference to the following description which shows a schematic diagram of a system incorporating the features of the present invention.

Referring to the drawing, the system includes a burner 2 in which two fuels are combusted. The first fuel, which is the regular fuel in the preferred system, is fed from a suitable storage receptical 4 through a suitable feed line 6 to the burner 2. The secondary fuel, which preferrably is a by-product fuel, is fed from its source (not shown) to a header 8. A suitable feed line 10 feeds the secondary fuel from the header to the burner 2.

The regular fuel feed line 6 includes a flow control valve 12 and, downstream therefrom, a flame safeguard shut off valve 14. The flow control valve 12 is preset open a small amount to satisfy base load requirements. The secondary fuel feed line 10 also includes a flow control valve 16 and a flame safeguard shut off valve 18. The flow control valve 16 may be either upstream or downstream of the flame safeguard shut off valve 18.

A demand sensor 20 is provided which sends a demand signal to a hand/automatic fuel proportioner 22 based upon the heat required. The signal from the sensor 20 is proportional to the required heat and is used by the fuel proportioner 22 to control the total amount of fuel supplied to the burner 2. A secondary fuel supply sensor 24 sends a control signal to the fuel proportioner 22 which determines the ratio in which the two fuels are to be supplied to the burner 2. The fuel proportioner then causes the operation of the two flow control valves 12 and 16 so that the required relative amounts of both the regular fuel and the secondary fuel are fed to the burner.

An on-off valve 25 is provided in the regular fuel feed line 6, downstream of the flow control valve 12 and the flame safeguard shut off valve 14. The signal from the secondary fuel supply sensor 24 is transmitted to a dual set point controller 26, which will cause the valve 25 to open when the supply of the secondary fuel falls below a predetermined minimum and will cause the valve 25 to close when the supply of secondary fuel rises above a predetermined amount. The set point at which the dual set point controller 26 will cause the valve 25 to close should be at a point just after the point the fuel proportioner has ceased calling for the principal fuel. The set point at which the dual set point controller 26 will cause the valve 25 to open should be just after the point when the flow proportioner 22 calls for the addition of the regular fuel to the burner.

In operation, with the heat demand sensor 20 determining the total amount of heat required, a signal is sent to the fuel proportioner 22. If the demand is relatively high such that the secondary fuel supply is not adequate to meet the demand and valve 25 is open, flow control valve 16 is opened for maximum supply of secondary fuel to the burner 2. Flow control valve 12 is opened a sufficient amount to provide the total combined fuel flow to the burner 2 to meet the required heat demand. If greater heat is demanded, the fuel proportioner causes valves 12 and 16, both, to further open permitting additional regular fuel to flow to the burner 2.

If sensor 24 detects a drop in the supply of the secondary fuel, a signal is sent to the fuel proportioner 22 which results in the valve 12 being opened an additional amount and valve 16 being closed a sufficient amount until the supply of secondary fuel begins building up to a point that valve 16 no longer needs to continue closing.

As the heat demand drops to a point where there is enough supply of secondary fuel to satisfy the demand, the signal from the heat demand sensor 20 will cause the fuel proportioner 22 to cause the two flow control valves 12 and 16 to begin closing. The signal from the fuel supply sensor 24, sensing a build up in the secondary fuel supply will cause valve 12 to further close and valve 16 to open. At a point just after the signal from the sensor 24 would cause the fuel proportioner 22 to cause the closing of valve 12 to its preset open point, the dual set point controller 26 will cause valve 25 to close.

If the heat demand begins to rise and the supply of secondary fuel is not sufficient to meet the heat requirements, the sensor 24 will sense the decrease in secondary fuel supply sending a signal to the fuel proportioner 22 which starts closing valve 16. At the same time, valve 12 begins to open. Additionally, the dual set point controller 26 will activate valve 25 to cause it to open at a point just after the flow proportioner 22 begins to open valve 12.

More specifically, the present invention may be used in connection with a boiler for the production of steam in a plant wherein a combustible gas, which is a by-product of a chemical process being carried out in the plant, is used as the secondary fuel. For example, according to the preferred embodiment, the secondary fuel is hydrogen which is produced as a by-product in the manufacture of chlorine and caustic in a chlor-alkali electrolytic cell. The regular fuel is preferably #2 fuel oil or such other common fuel as may be used in plant boilers.

Referring to the drawing, the burner 2, according to the preferred embodiment of the invention, may be a boiler including a fire box 28 in which both the regular fuel and secondary fuel are combusted, and a steam chest 30 wherein water is converted into steam by the heat of combustion of the fuels.

The regular fuel, fuel oil in the preferred embodiment, is fed from its storage receptical 4 through feed line 6 and valves 12, 14 and 25 to an appropriate nozzle 32 in the firebox 28 where the fuel is atomized for proper burning. The by-product fuel, hydrogen gas in the preferred embodiment, is fed from its source to header 8 and then through feed line 10 and valves 16 and 18 to one, or preferably a plurality of gas spuds 34 positioned in the firebox 28.

The heat demand sensor 20 is preferably a part of the boiler controls and senses steam flow. It would also be possible to sense steam pressure if desired. The sensor 20 may be of a type that transmits a pneumatic signal through line 36 to the fuel proportioner 22. This signal from sensor 20 is a pressure signal, proportional to the steam flow. By way of example, this signal may range from about 3 to about 15 psi (pounds per square inch), with the lowest pressure occuring when steam flow is lowest and the highest pressure occurring when steam flow is the greatest.

The hand/automatic fuel proportioner 22 is of the type that takes the pressure signal from the sensor 20 and splits it into two paths 38 and 40, path 38 going to valve 12 and path 40 going to valve 16. Valves 12 and 16 are both pneumatic operated flow control valves. The pressure signal from the fuel proportioner 22 causes the valves 16 and 18 to further open or further close depending upon the magnitude of the signal. A high pressure signal will tend to further open the valves and a low pressure signal will tend to further close the valves.

The secondary fuel supply sensor 24 may be a differential pressure transmitter which is attached to the head 8 for the secondary fuel and which senses the pressure in the header and transmits a pneumatic signal to the fuel proportioner 22 proportional thereto through line 42. By way of example, the pressure of the hydrogen in header 8 may vary from about 0 to about 6 psi. The differential pressure transmitter senses this pressure and converts it to a proportional pressure signal of about 3 to about 15 psi which is transmitted to the fuel proportioner 22.

The fuel proportioner 22 uses the pressure signal from the secondary fuel supply sensor 24 to proportion the pressure signal from the sensor 20 between the two paths 38 and 40 and thus proportions the flow of the regular and secondary fuel through the opening and closing of valves 12 and 16 respectively. When the pressure in header 8 decreases, thus indicating a decrease in supply of secondary fuel, the pressure signal from the differential pressure transmitter 24 will decrease. The fuel proportioner 22, upon receiving a lower pressure signal from the differential pressure transmitter 24, will respond by permitting more of the pneumatic pressure from the sensor 20 to flow through line 38 to valve 12 and less pneumatic pressure from the sensor 20 to flow through line 40 to valve 16. This results in valve 12 further opening and more regular fuel flowing to the burner 2 and the valve 16 further closing and less secondary fuel flowing to the burner 2. An increase in pressure in the header 8 as sensed by the differential pressure transmitter 24, indicating an increase in secondary fuel supply will have the opposite result. The increased pressure signal from the differential pressure transmitter 24 will cause the fuel proportioner 22 to permit more of the pneumatic pressure from sensor 20 to flow to valve 16 and less to flow to valve 12. As a result, in this case, valve 16 will further open permitting more secondary fuel to flow to burner 2 and valve 12 will begin to close whereby less regular fuel will flow to the burner 2.

The differential pressure transmitter 24 also transmits the pressure signal proportional to the secondary fuel supply to the dual set point controller 26 through an appropriate flow line 44. The dual set point controller 26 may be a dual range pressure switch. The on-off valve 25 is preferably a solenoid operated on-off valve to which the dual range pressure switch is electrically connected. The dual range pressure switch has two set points, a high pressure set point and a low pressure set point. At the low pressure set point, the solenoid actuated valve 25 will turn on permitting flow of the regular fuel to the burner 2. At the high pressure set point, the solenoid actuated valve 25 will shut off.

The flame safeguard shut off valves 14 and 18 are valves which will shut off the flow of fuel when various potentially unsafe conditions are encountered. Such conditions may include high or low boiler pressure, fuel supply problems, low water level, loss of draft, and a black out condition.

By virtue of the above described arrangement, the flow of primary fuel to the burner 2 is controlled in an on-off fashion permitting use of as much of the secondary fuel as needed and as available. In addition, the positioning of the on-off valve 25 in the regular fuel line 6 downstream of the flame safeguard shut off valve 14, permits the flame safeguards to be satisfied and flame safeguard valve 14 to be open without the regular fuel flowing to the burner 2. Valve 14 can remain open thereby eliminating the need to execute the regular fuel start-up cycle each time the regular fuel is called for by the fuel proportioner 22.

What is claimed is:

1. A system for burning at least two fuels in a burner wherein the second fuel is available in varying amounts, said system comprising:

(a) first supply means for supplying a first fuel to the burner;

(b) second supply means for supplying a second fuel to the burner;

(c) transmitter means for sensing the available supply of said second fuel;

(d) demand sensor means for sensing the total fuel required to be sent to the burner;

(e) first controller means for controlling the flow of said first fuel to said burner;

(f) second controller means for controlling the flow of said second fuel to said burner;

(g) on-off valve means for shutting off or turning on the supply of said first fuel to said burner;

(h) proportioning means operative in response to the sensing of the available supply of said second fuel and the total fuel required for proportioning the total fuel supplied to the burner between the first and second fuel to use as much of the second fuel to meet the total fuel requirement; and (i) controller means operative in response to the sensing of the available supply of said second fuel for closing said on-off valve means when the available supply of said second fuel is adequate to meet the total fuel requirement and for opening said on-off valve means when the available supply of said second fuel is inadequate to meet the total fuel requirement; and (j) first and second flame safeguard valve means, positioned toward said first and second supply means from said off-on valve means and second controller means, respectively, for automatically shutting off the supply of first and second fuels responsive to existence of any one of a plurality of potentially unsafe conditions.

* * * * *